US006354367B1

(12) United States Patent
Gong et al.

(10) Patent No.: US 6,354,367 B1
(45) Date of Patent: Mar. 12, 2002

(54) AIR CONDITIONING UNIT HAVING COIL PORTION WITH NON-UNIFORM FIN ARRANGEMENT

(75) Inventors: Ying Gong, Tyler, TX (US); Timothy B. Hawkins, Fort Smith, AR (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/782,269

(22) Filed: Feb. 12, 2001

(51) Int. Cl.[7] ..... F28B 1/06
(52) U.S. Cl. ..... 165/125; 165/151; 165/122
(58) Field of Search ..... 165/122, 124, 165/125, 151; 62/507, 508, 515, 518

(56) References Cited

U.S. PATENT DOCUMENTS

| | | | | |
|---|---|---|---|---|
| 2,055,549 A | | 9/1936 | Modine | 257/130 |
| 2,268,361 A | | 12/1941 | Walker et al. | 257/134 |
| 2,613,065 A | | 10/1952 | Didier | 257/124 |
| 3,267,692 A | | 8/1966 | Pfeiffer et al. | 62/515 |
| 3,313,123 A | | 4/1967 | Ware | 62/272 |
| 4,434,841 A | * | 3/1984 | Jackson et al. | 165/125 |
| 4,554,968 A | * | 11/1985 | Haas | 165/125 |
| 5,067,562 A | | 11/1991 | Ishii | 165/146 |
| 5,443,042 A | | 8/1995 | Kiefer | 123/41.49 |
| 5,896,920 A | | 4/1999 | Jun | 165/146 |

FOREIGN PATENT DOCUMENTS

| | | | | |
|---|---|---|---|---|
| JP | 56-87728 A | * | 7/1981 | 165/125 |
| JP | 59-161687 A | * | 9/1984 | 165/125 |

* cited by examiner

*Primary Examiner*—Ira S. Lazarus
*Assistant Examiner*—Terrell McKinnon
(74) *Attorney, Agent, or Firm*—Konneker & Smith, P.C.

(57) ABSTRACT

An air conditioning unit, representatively an outdoor condensing unit, is provided with a vertically oriented fin/tube coil portion through which a fan inwardly draws ambient air in a generally horizontal direction. The coil has a non-uniform fin arrangement that provides a bottom portion of the coil with an effective fin density lower than that of an upper portion of the coil.

28 Claims, 1 Drawing Sheet

AIR CONDITIONING UNIT HAVING COIL PORTION WITH NON-UNIFORM FIN ARRANGEMENT

BACKGROUND OF THE INVENTION

The present invention generally relates to heat exchange apparatus and, in a preferred embodiment thereof, more particularly relates to an air conditioning unit, such as an outdoor condensing unit, having incorporated therein a coil portion with a specially designed non-uniform fin arrangement.

The coil portion of an air conditioning unit, such as an outside condensing unit, is typically made up of parallel tubing sections through which refrigerant is flowed, and a series of parallel, thin fin members transversely secured to the tubing sections in a closely spaced arrangement. Conventionally, the number of fins per inch (FPI) is kept constant over the entire face area of the coil. To force air through the fin spaces and externally across the tubing sections a fan structure is typically employed. Due to the placement of the fan structure relative to the coil it is common for the coil to have on different areas thereof substantially different face velocities of air traversing it.

This nonuniform air velocity through different portions of the coil often creates a variety of operational problems and inefficiencies for the air conditioning unit in which the coil is incorporated, including making condensate drainage difficult, increasing the possibility for icing up of certain coil portions, and lowering the overall heat exchange capability of the coil. It is to these problems that the present invention is directed.

SUMMARY OF THE INVENTION

In carrying out principles of the present invention, in accordance with a preferred embodiment thereof, heat exchange apparatus is provided which is representatively in the form of an outdoor condensing unit portion of a direct expansion air conditioning system.

From a broad perspective the heat exchange apparatus comprises a heat transfer coil including a plurality of parallel tube sections laterally spaced apart in a first direction and through which a fluid may be flowed, and a mutually spaced series of parallel fin members transversely secured to the tube sections. The heat exchange apparatus also comprises fan apparatus associated with the heat transfer coil and operative to flow air therethrough, between the fin members and externally across the tube sections, in an air flow direction.

According to one aspect of the invention, the fin members have major dimensions which extend generally parallel to the first direction, the major dimensions varying generally transversely to the air flow direction and generally parallel to the first direction. According to another aspect of the invention, the air-to-fin contact area of the heat transfer coil varies generally transversely to the air flow direction and generally parallel to the fins and the first direction. Other features of the invention include, in various combinations with these aspects, that the air flow direction across the coil is generally transverse to the first direction, the fin spacing is substantially uniform, and that the thicknesses of the fins are substantially uniform.

AS representatively embodied in an outdoor condensing unit, the invention provides a generally vertically oriented coil in which the parallel tube sections are laterally spaced apart in a vertical direction, and the fins are transversely secured to the tube sections. Fins which extend from the top of the coil to the bottom of the coil are horizontally interdigitated with shorter fins which extend from the top of the coil to a location which is spaced upwardly apart from the bottom of the coil. In this manner, the fin density and air-to-fin contact area along a bottom portion of the coil are substantially reduced relative to the fin density and air-to-fin contact area along an upper portion of the coil.

During operation of the fan, ambient outside air is flowed generally horizontally inwardly through the coil into the interior of the condensing unit, thereby receiving heat from the coil, and then vertically discharged from the condensing unit. The lowered fin density in the bottom portion of the coil reduces the air pressure drop across such bottom portion and provides the condensing unit with a variety of advantages over condensing units having conventionally configured fin/tube coils, such advantages including material cost savings, weight reduction, enhanced air side convective heat transfer, improved air velocity profiles, lowered air side pressure drop, improved condensate drainage efficiency, lowered frost and ice accumulation on the coil, lowered thermal coil stress, and easier cleaning of the bottom coil portion.

While the present invention is illustrated and described herein as being incorporated in the heat transfer coil of an outside condensing unit portion of a direct expansion air conditioning system, the present invention could also be advantageously utilized in other types of heat transfer coils, such as indoor evaporator coils in furnaces and heat pump units, if desired. Also, principles of the present invention could be advantageously utilized in flat coils, and coils which have a non-vertical orientation.

DETAILED DESCRIPTION

Figure 1:
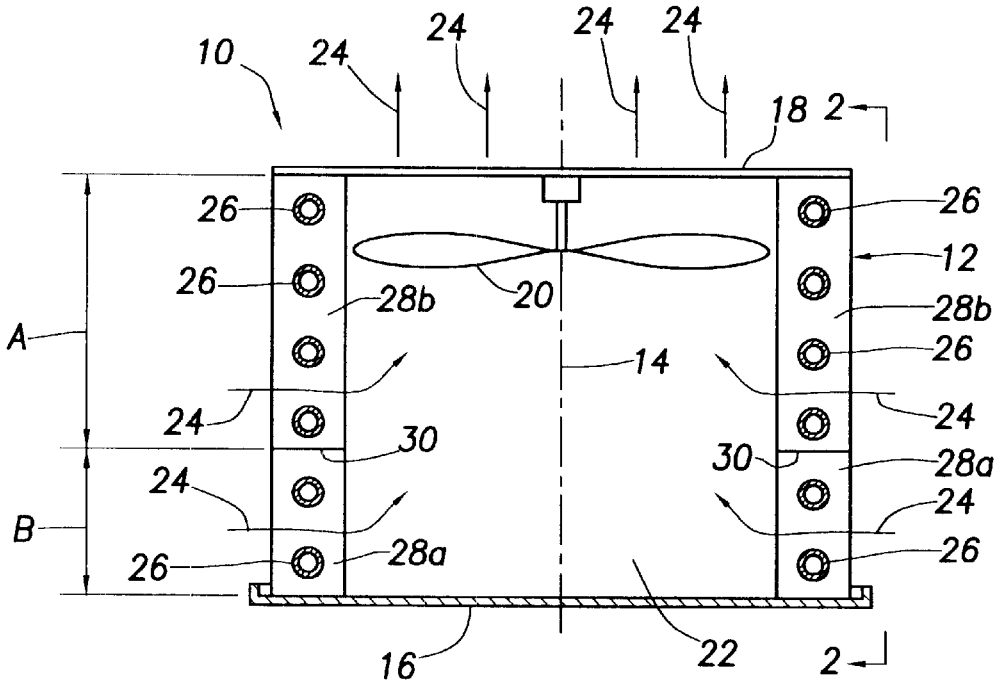
FIG. 1 is a simplified cross-sectional view through an air conditioning system condensing unit embodying principles of the present invention.

The present invention provides improved heat exchange apparatus which is representatively in the form of an outside condensing unit 10 depicted in simplified, somewhat schematic form in FIG. 1 and incorporated in a direct expansion air conditioning system. The condensing unit 10 includes a specially configured, vertically oriented fin/tube heat transfer coil 12 that encircles a vertical axis 14 and extends upwardly from a suitable base pan 16 to an apertured top wall 18. A fan 20 rotationally drivable about the axis 14 is disposed within an upper portion of the interior 22 of the condensing unit 10 and supported on the top wall 18. During rotation of the fan 20, ambient outside air 24 is forcibly drawn generally horizontally through the coil 12 into the interior 22 of the condensing unit 10, and then discharged upwardly through the apertures in the top wall 18.

The coil 12 includes a vertically spaced series of parallel, horizontally extending metal tube sections 26 (representatively copper tube sections) that extend outwardly around the vertical axis 14, and a closely spaced series of vertically elongated rectangular metal fins 28 (representatively aluminum fins) which are transversely secured to the tubing sections 26 in heat transfer relationships therewith. AS the ambient air 24 is being horizontally drawn inwardly through the coil 12 by the fan 20, the air 24 passes through the spaces between the fins 28, and externally across the tube sections 26 generally transversely to lateral spacing direction of the tube sections, and receives heat from the coil 12 to thereby cool refrigerant being flowed through the tube sections 26 by a compressor (not shown).

Due to the positioning of the fan 20 relative to the coil 12, the fan-induced air pressure drop horizontally inwardly across the coil 12 is greater along a top portion A of the coil 12 than it is along a bottom portion B of the coil 12. In a conventionally configured condensing coil, both the fin spacing and fin density (i.e., fins/inch) on the tube sections 26 would be uniform around the entire face area of the coil. Because of these aspects of a conventionally configured coil, the inward air flow per area of the bottom coil portion B is substantially lower than the inward air flow per area of the top coil portion A. In such conventionally configured coil this air flow differential typically presents several operational and heat transfer efficiency problems such as, for example, reduced air side convective heat transfer, undesirable air velocity profiles and air pressure drops, reduced condensate drainage efficiency, increased frost or ice accumulation on the coil, and increased thermal stress on the coil.

Figure 2:
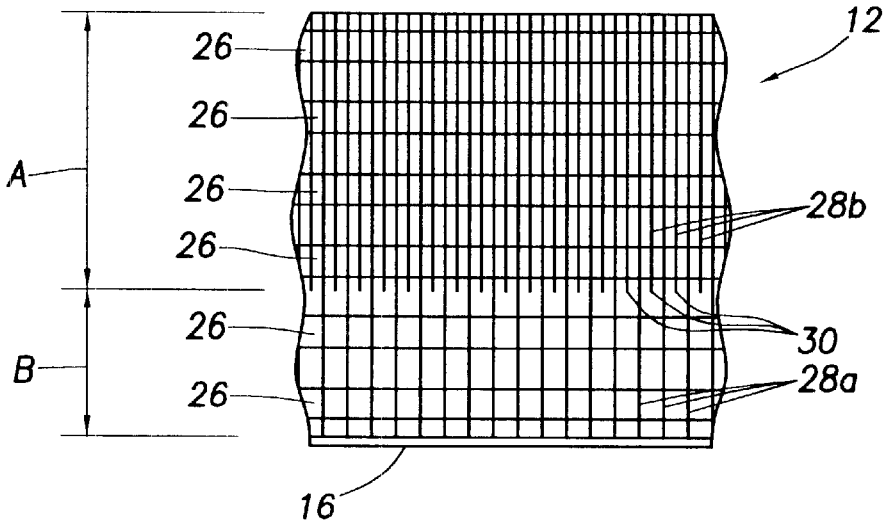
FIG. 2 is an outer side elevational view, taken along line 2—2 of FIG. 1, of a portion of a specially designed fin/tube coil structure incorporated in the condensing unit.

With reference now to FIGS. 1 and 2, In the present invention these problems are substantially alleviated by providing the coil 12 with a lower effective fin density, and thus a lower air-to-fin contact area, along the bottom portion B of the coil 12 compared to the top portion A of the coil 12. This is accomplished by interdigitating fins 28*a*, which extend the full height of the coil 12 (i.e., through both of the coil portions A and B) with vertically shorter fins 28*b* that vertically extend only through the top portion A of the coil 12, with the bottom edges 30 of the vertically shorter fins 28*b* being positioned at the upper end of the bottom coil portion B.

AS can be seen in FIG. 2, this provides the specially configured coil 12 with an effective fin density (and thus an air-to-fin contact area) along the bottom coil portion B which is half that in the upper coil portion A. Accordingly, the velocity of the ambient air 24 which is being drawn by the fan 20 through the bottom portion B of the coil 12 is substantially increased compared to the velocity that it would have in a conventionally configured coil in which the fin density was constant throughout the coil. This unique configuration of the coil 12 provides a variety of advantages over conventionally configured coils including, for example, material cost savings, weight reduction, enhanced air side convective heat transfer, improved air velocity profiles, lowered air side pressure drop, improved condensate drainage efficiency, lowered frost and ice accumulation on the coil, and lowered thermal coil stress.

AS can be seen in FIG. 1, the coil 12 is configured and arranged in a manner such that a unique combination of directional and geometric features are representatively provided. For example, and by way of illustration only, (1) the air flow direction through the coil 12 is generally transverse to the lateral tube spacing direction; (2) the air-to-fin contact area of the coil 12 varies in a direction generally parallel to the lateral tube section spacing direction (being greater in the top coil portion A than in the bottom coil portion B), generally transversely to the air flow direction through the coil 12, and generally parallel to the fins 28; (3) major dimensions of the fins 28 (representatively their heights) are varied in directions generally transverse to the direction of air flow through the coil 12, and generally parallel to the lateral tube section spacing direction; (4) the fin-to-fin spacing of the differently configured fins 28*a*,28*b* is substantially uniform; and (5) the thicknesses of the fins 28*a*, 28*b* are substantially uniform. While each of these characteristics is representatively incorporated in the illustrative coil 12, it will be readily appreciated by one of ordinary skill in this particular art that not all of these characteristics need be incorporated in the coil 12 to obtain at least some of the benefits listed above for the improved coil 12.

AS will also be readily appreciated by those of ordinary skill in this particular art, a variety of modifications could be made to the representatively illustrated coil 12 without departing from principles of the present invention. For example, only two fin sizes are used in the coil 12. However, more than two fin sizes could be used, and the fins could be interdigitated in other manners, if desired. Additionally, the present invention could also be advantageously utilized in other types of heat transfer coils, such as indoor evaporator coils in furnaces and heat pump units, if desired. Also, principles of the present invention could be advantageously utilized in flat coils, and coils which have non-vertical orientations.

The foregoing detailed description is to be clearly understood as being given by way of illustration and example only, the spirit and scope of the present invention being limited solely by the appended claims.

What is claimed is:

1. Heat exchange apparatus comprising:

a heat transfer coil including:

a plurality of parallel tube sections laterally spaced apart in a first direction and through which a fluid may be flowed, and a mutually spaced series of parallel fin members transversely secured to said tube sections; and fan apparatus associated with said heat transfer coil and operative to flow air therethrough, between said fin members and externally across said tube sections, in an air flow direction, said fin members having major dimensions which extend generally parallel to said first direction, said major dimensions varying generally transversely to said air flow direction and generally parallel to said first direction.

2. The heat exchange apparatus of claim 1 wherein:

said air flow direction is generally transverse to said first direction.

3. The heat exchange apparatus of claim 2 wherein:

the air-to-fin contact area of said heat transfer coil varies generally transversely to said air flow direction.

4. The heat exchange apparatus of claim 2 wherein:

the air-to-fin contact area of said heat transfer coil varies in a direction generally parallel to said first direction.

5. The heat exchange apparatus of claim 2 wherein:

the air-to-fin contact area of said heat transfer coil varies in a direction generally parallel to said fin members.

6. The heat exchange apparatus of claim 2 wherein:

the lateral spacing of said fin members is substantially uniform.

7. The heat exchanger of claim 2 wherein:

the thicknesses of said fin members are substantially identical.

8. The heat exchange apparatus of claim 1 wherein:

the air-to-fin contact area of said heat transfer coil varies generally transversely to said air flow direction.

9. The heat exchange apparatus of claim 8 wherein:

the lateral spacing of said fin members is substantially uniform.

10. The heat exchange apparatus of claim 1 wherein:

the lateral spacing of said fin members is substantially uniform.

11. The heat exchange apparatus of claim 10 wherein:

the thicknesses of said fin members are substantially identical.

12. The heat exchange apparatus of claim 1 wherein:

the thicknesses of said fin members are substantially identical.

13. The heat exchange apparatus of claim 1 wherein:

said heat exchange apparatus is an air conditioning unit.

14. The heat exchange apparatus of claim 13 wherein:

said air conditioning unit is a condensing unit.

15. The heat exchange apparatus of claim 1 wherein:

said heat transfer coil has a peripheral portion with a lower fin density than an adjacent portion of said heat transfer coil.

16. The heat exchange apparatus of claim 15 wherein:

said heat transfer coil is generally vertically oriented, and said peripheral portion of said heat transfer coil is a bottom portion thereof.

17. Heat exchange apparatus comprising:

a heat transfer coil including:

a plurality of parallel tube sections laterally spaced apart in a first direction, and a single mutually spaced series of parallel, interdigitated fin members transversely secured to said tube sections and having substantially equal thicknesses, a first group of said interdigitated fin members being secured to more of said tube sections than a second group of said interdigitated fin members; and fan apparatus associated with said heat transfer coil and operative to flow air therethrough, between said fin members and externally across said tube sections, in an air flow direction, the air-to-fin contact area of said heat transfer coil varying generally transversely to said air flow direction and generally parallel to said fin members and said first direction.

18. The heat exchange apparatus of claim 17 wherein:

said air flow direction is generally transverse to said first direction.

19. The heat exchange apparatus of claim 18 wherein:

said fin members have major dimensions which extend parallel to said first direction, said major dimensions varying generally transversely to said air flow direction and generally parallel to said first direction.

20. The heat exchange apparatus of claim 17 wherein:

said fin members have major dimensions which extend parallel to said first direction, said major dimensions varying generally transversely to said air flow direction and generally parallel to said first direction.

21. The heat exchange apparatus of claim 20 wherein:

the lateral spacing of said fin members is substantially uniform.

22. The heat exchange apparatus of claim 17 wherein:

the lateral spacing of said fin members is substantially uniform.

23. The heat exchange apparatus of claim 22 wherein:

said air flow direction is generally transverse to said first direction.

24. The heat exchange apparatus of claim 23 wherein:

said fin members have major dimensions which extend generally parallel to said first direction, said major dimensions varying generally transversely to said air flow direction and generally parallel to said first direction.

25. The heat exchange apparatus of claim 17 wherein:

said heat exchange apparatus is an air conditioning unit.

26. The heat exchange apparatus of claim 25 wherein:

said air conditioning unit is a condensing unit.

27. The heat exchange apparatus of claim 17 wherein:

said heat transfer coil has a peripheral portion with a lower fin density than an adjacent portion of said heat transfer coil.

28. The heat exchange apparatus of claim 27 wherein:

said heat transfer coil is generally vertically oriented, and said peripheral portion of said heat transfer coil is a bottom portion thereof.

* * * * *